United States Patent [19]

Zelnick

[11] 4,044,529

[45] Aug. 30, 1977

[54] PALLET STRETCH-WRAP APPARATUS

[75] Inventor: Seymour Zelnick, Somerville, N.J.

[73] Assignee: Weldotron Corporation, Piscataway, N.J.

[21] Appl. No.: 680,849

[22] Filed: Apr. 27, 1976

[51] Int. Cl.[2] ..... B65B 13/08

[52] U.S. Cl. ..... 53/198 R; 53/210; 53/229; 100/17

[58] Field of Search ..... 53/198 R, 210, 228, 53/229; 100/17, 18

[56] References Cited

U.S. PATENT DOCUMENTS

| | | | |
|---|---|---|---|
| 3,596,434 | 8/1971 | Zelnick | 53/198 R |
| 3,910,005 | 10/1975 | Thimon et al. | 53/198 R X |
| 3,930,442 | 1/1976 | Buttner | 53/198 R X |

*Primary Examiner*—Travis S. McGehee
*Attorney, Agent, or Firm*—Robert A. Green

[57] ABSTRACT

The disclosure is of apparatus including a pallet load which is to be wrapped with film, the pallet and load being horizontally movable along a straight-line path from a loading area to a wrapping station. At the wrapping station, there are a fixed vertical roll of wrapping film and a movable vertical roll of wrapping film, and the film to be wrapped around the load extends, as a curtain, between the two rolls. When the pallet load is moved into the wrapping station, it is pushed into the curtain of film which partially encloses the load, and the movable roll is driven toward the fixed roll to complete the wrapping of the film about the load and to provide a region where two layers of film overlap each other. With the load thus completely enclosed, a clamping bar secures the seal area, and a heat-sealing device is used to seal the overlapping layers of film to complete the wrap. The film is then cut in the seal area, the movable roll is returned to its starting position to re-form the curtain of film, and the wrapping operation is ready to be repeated.

33 Claims, 5 Drawing Figures

Fig. 1
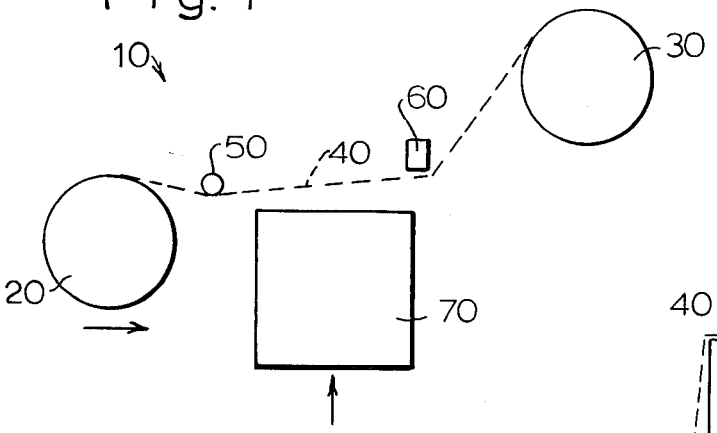
Fig. 2
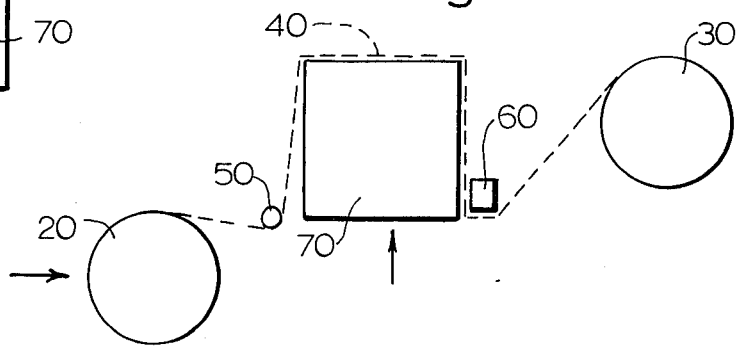
Fig. 3
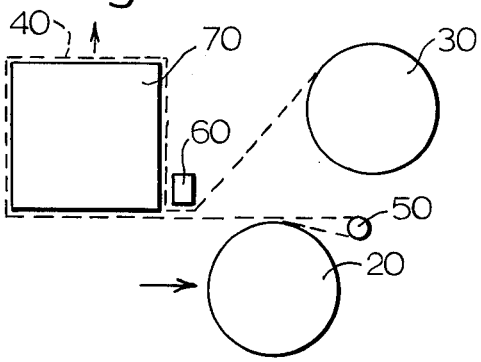
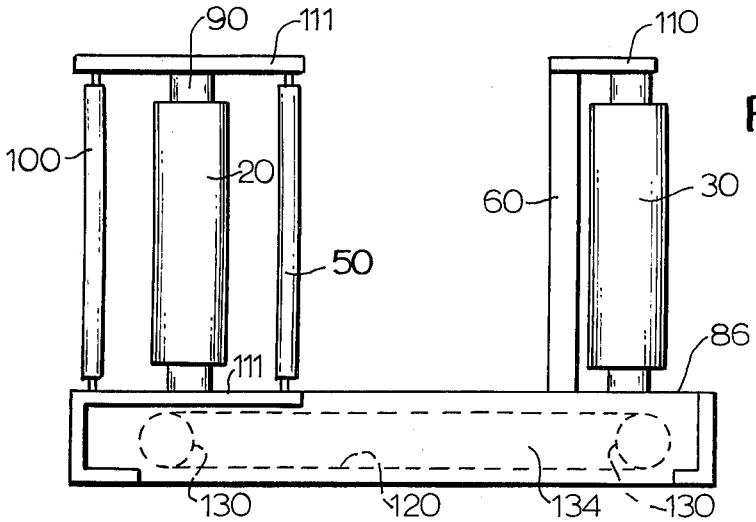
Fig. 5

Fig. 6
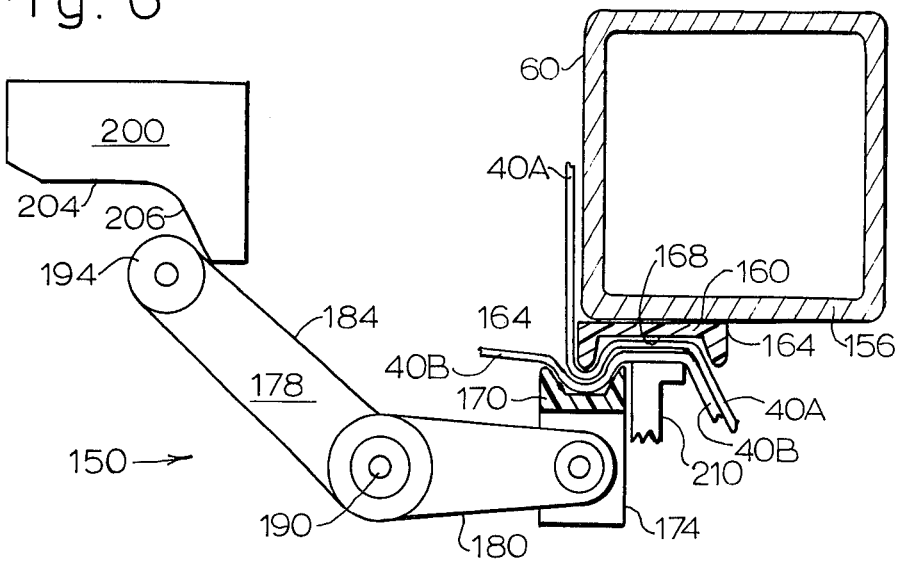
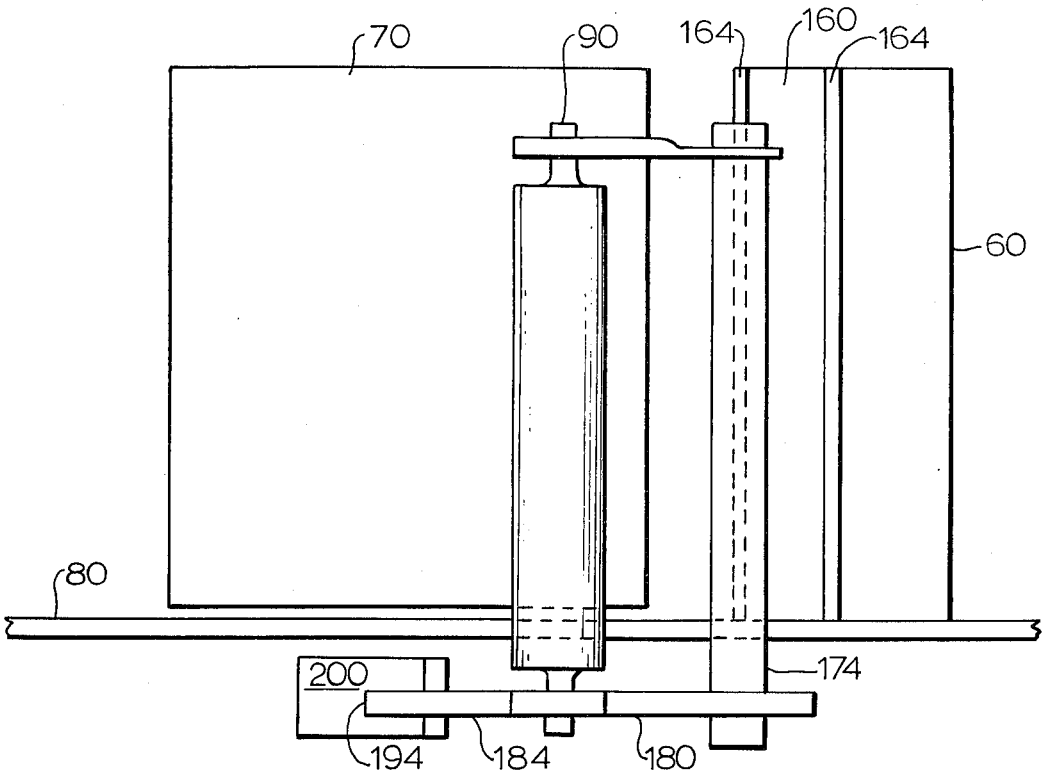
Fig. 7

PALLET STRETCH-WRAP APPARATUS

BACKGROUND OF THE INVENTION

It is now a widely accepted technique to unitize pallet loads of product by encapsulating them in shrink or stretch film. The initial applications primarily involved shrink film, but, with increased emphasis on energy conservation, the use of the stretch film technique is becoming increasingly important.

The principal methods known for stretch-wrapping pallet loads at present are a high-speed system using two rolls of film, as disclosed in U.S. Pat. No. 3,596,434, and a lower-speed system using one roll of film, as disclosed in U.S. Pat. No. 3,867,806. The two-roll system disclosed in U.S. Pat. No. 5,596,434 is a fully automatic system designed for production rates of 100 to 200 loads per hour, and, while it has the advantage of unitizing the pallet load with only one layer of film, it is relatively expensive and has the functional disadvantage of manipulating the load during the wrapping process. In general, it is suitable for only the larger producers. The single roll rotary system as disclosed in U.S. Pat. No. 3,867,806 is a lower cost system which is suitable for smaller producers but has the disadvantage of requiring a minimum of three layers of film to unitize a load.

The present invention, described below, provides film wrap apparatus which operates at relatively high speed, is relatively inexpensive, and requires only a single layer of film to unitize a load.

DESCRIPTION OF THE DRAWINGS

FIG. 1 is a schematic plan view of the invention at one stage in its operation;

FIG. 2 is a schematic plan view of the apparatus of FIG. 1 at a second stage in its operation;

FIG. 3 is a schematic plan view of the apparatus of FIG. 1 at a third stage in its operation;

FIG. 5 is a front elevational view of the apparatus of FIG. 4;

FIG. 6 is a plan view of a portion of the apparatus of FIG. 5; and

FIG. 7 is a front elevational view of the apparatus of FIG. 6.

DESCRIPTION OF THE PREFERRED EMBODIMENTS

Figure 4:
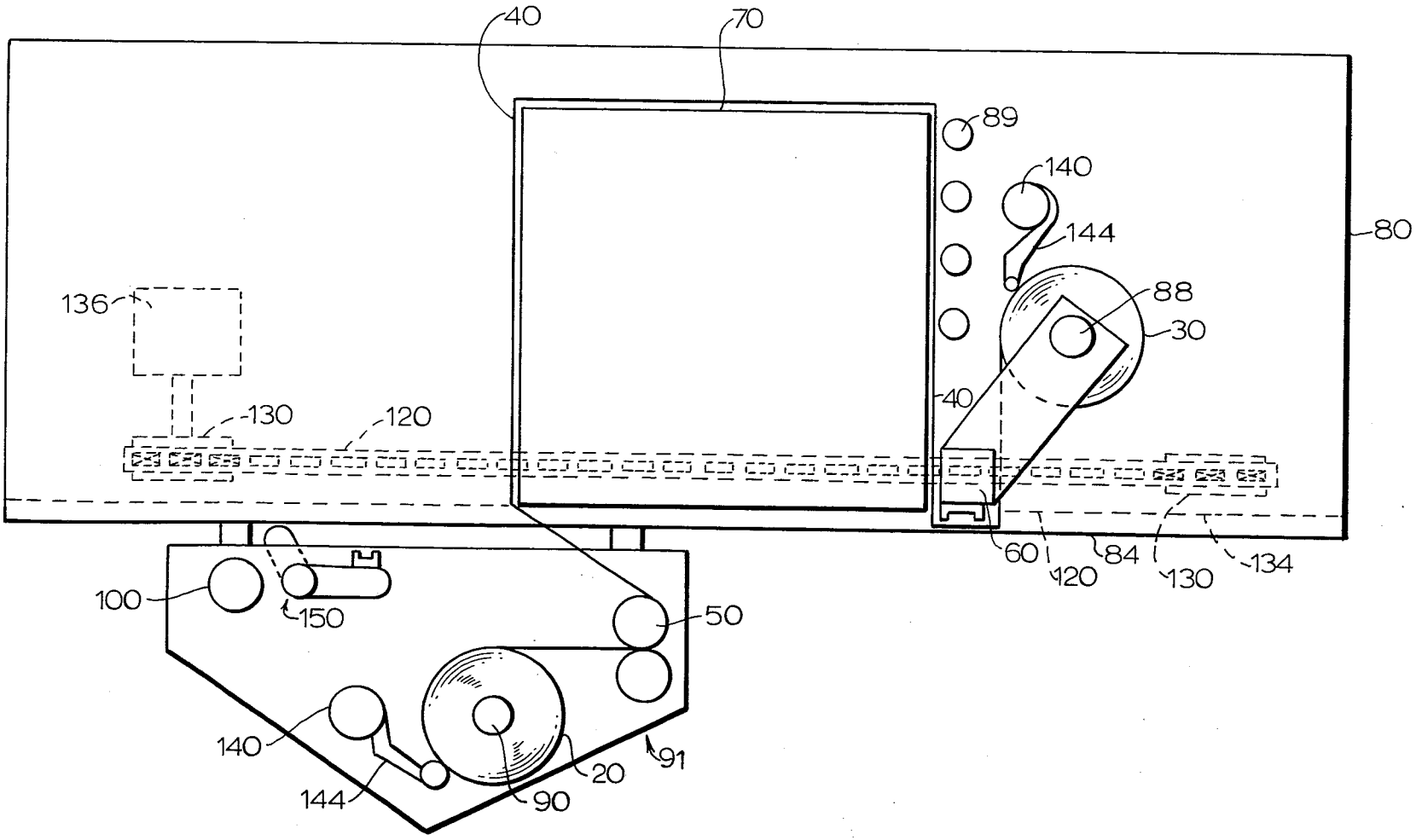
FIG. 4 is a plan view of a more detailed representation of the invention.

Apparatus embodying the invention 10 is shown in schematic form in FIGS. 1 to 3. The apparatus includes a movable roll of film 20 and a fixed roll of film 30, with the films from each roll secured together to form a continuous curtain of film 40 between the rolls. The rolls of film are disposed vertically to form a vertical curtain of film. A vertical film guide or idler roll 50, movable with film roll 20, is positioned adjacent a film roll 20 but in front of or ahead of roll 20 in its path of travel. A fixed vertical clamping bar 60 is positioned adjacent to the fixed film roll 30 but to the left of roll 30, as seen in FIG. 1.

Between the rolls 20 and 30 is a load-wrapping area or station and a pallet and its load, called a pallet load, or load, are pushed into the curtain of film 40 by means of a fork-lift truck or conveyor, or the like, to the position shown in FIG. 2 wherein the load is behind roll 20 and the film curtain encloses three sides of the load. The movable film roll 20 and the idler roll 50 are mounted on a movable carriage which is driven from left to right, as seen in FIGS. 2 and 3, to complete the wrapping of the load with the film and to provide two layers of the film on the clamping bar 60, as seen in FIG. 3.

Braking force is applied to the film rolls at the start of movement of the movable roll from left to right, or shortly thereafter, to increase film tension to a desired level, to thus stretch the film around the load. The two layers of film on the clamping bar 60 are clamped in place and heat-sealed, and the film is cut to complete the packaging of the load. The packaged load is removed, and the movable film roll 20 and idler 50 are returned to the left to their starting position to prepare the apparatus to receive and wrap another load.

A somewhat more detailed schematic representation of portions of the invention shown in FIGS. 4 and 5 includes a horizontal platform 80 which supports the load 70 at the central portion of the top surface thereof. The platform has a front edge 84 and a top surface 86. The fixed roll of film 30 is threaded on a vertical post 88 secured to the top surface of the platform at the right-hand portion thereof, adjacent to the load. The post 88 is rigidly coupled to the sealing bar 60 by a top plate 110 to form a rigid assembly. A plurality of vertical side guide rollers 89 are disposed along the top surface of the platform adjacent to the side of the load as a guide for the film 40 and the load.

The movable film roll assembly 91 comprises a rigid assembly of a vertical post 90 for the roll of film 20, the film guide roll or idler 50 to the right, or on the load side, thereof, and a structural reinforcing bar or roll 100 to the left. These three rolls 50, 90, and 100 are secured together by plates 111 at top and bottom to form a rigid assembly. This assembly is suitably coupled to a drive chain 120 which is threaded on sprockets 130, and this drive assembly is suitably supported in a channel 134 beneath the top surface of the platform at the front edge thereof (FIG. 5). A motor 136 is coupled to the sprockets or chain to drive the chain and cause the movable roll film assembly to move to the right and the left, as seen in FIGS. 3 and 4.

A potentiometer brake 140 having an arm 144 in contact with the film roll is provided for each roll of film 20 and 30 to control rotation of the rolls and the tension on the film as the apparatus 10 is operated, as described below.

The apparatus 10 includes a film clamping and sealing means comprising a pivotable clamping assembly 150, mounted on and movable with, the movable film roll assembly 91, and the fixed clamping sealing post 60 mounted on the platform 80 adjacent to the front edge of the platform and adjacent to the right-hand corner of the load 70, between roll 30 and the load.

This apparatus for clamping and sealing the films is shown in greater detail in FIGS. 6 and 7. The vertical clamping bar 60 is shown as a metal tube having a generally rectangular cross-section, and, extending along its front surface 156 from top to bottom, it carries a generally flat insulating plate 160 having projecting portions 164 extending from top to bottom along its left and right edges. The flat portion 168 provided between the projecting portions 164 comprises the film sealing area on which film to be sealed is seated. The plate 160 is preferably made of an insulating resilient material such as rubber.

The pivotable assembly 150 includes a vertical member 170 for mating with the plate 160 secured to bar 60, and this member comprises a generally U-shaped plate which is of a size to engage or mate with the leftmost of the projecting portions 164 of the plate 160. The second plate 170 is also of an insulating resilient material, and it is carried by a vertical bar 174, to which are secured upper and lower levels 178. The levers 178 each includes a first lever arm 180 which carries the bar 174 and a second lever arm 184 extending therefrom at an angle. The lever 178 pivots about a vertical post 190 disposed at the junction of the arms 180 and 184. The lower lever 178 has a cam follower 194 at the end of its arm 184 which operates in conjunction with a cam 206 which is shaped as shown and which is secured to platform 80. The relationship is such that, as the movable film assembly 91 moves to the right, at a predetermined location, the cam follower 194 engages and rides along the horizontal surface 204 of the cam, and, as it approaches the vertically sloped portion, levers 178 rotate about the pivot point 190 and bring the bar 174 and U-shaped plate 170 into engagement with the first U-shaped plate 160, with the overlapping film layers 40A and 40B between them.

With the parts thus positioned, a heat-sealing bar 210 is brought into engagement with the overlapping film material which extends vertically along the flat portion 168 of plate 160, and the desired seals are formed. This sealing operation may be performed by hand or automaticlly.

In operation of the apparatus of the invention 10, initially, the ends of the rolls of film are sealed together in any suitable manner, and, with the movable film carriage 91 retracted to the left, the film 40 is stretched across the front of the platform, as a curtain, and across the portion of the platform which is to receive the load to be wrapped. The pallet and load are then pushed toward and onto the platform by a fork-lift truck or conveyor, engaging the curtain of film as they go so that the film extends from the movable supply roll, over the guide roll, around the back of the load, over the plate 160 on the clamping bar, and to the fixed supply roll. The load is enclosed on three sides at this time.

Now, the movable carriage 91 is driven to the right, and the film is drawn across the front of the load and across the front of the clamping post 60 and beyond this post a suitable distance. At the start of this movement of the carriage, the brakes 140 are applied to the film supply rolls 20 and 30 to increase the film tension around the article to a desired, predetermined level, and thus to stretch the film a predetermined amount.

When the carriage 91 reaches a predetermined location on its path of travel, as described, the cam follower 194 engages the cam 200, rotates the bar 174, and brings the clamping plate 170 into engagement with the plate 160 with two layers of film 40A and 40B between these two parts. With the film thus clamped, the tension in the film to the right of the clamping bar is relaxed, by retracting the movable carriage slightly, and the films which rest on the flat portion 168 are heat-sealed from top to bottom. Finally, the film is cut along the seal, the wrapped load is removed, and the carriage is retracted to release the clamping plate 170 from plate 160 and to re-form the curtain of film 40 to prepare the apparatus to wrap another load.

The apparatus of the invention represents a considerable improvement over the prior art since it is relatively simple in construction, yet can produce a single-layer stretch-wrap completely equivalent to that produced by the more complex automatic equipment of the prior art.

What is claimed is:

1. Apparatus for stretch-wrapping a load with stretchable film comprising a fixed first roll, a second roll including first means for moving said second roll toward and away from said first roll, wrapping film wound on said rolls and forming a continuous curtain between said first and second rolls, said second roll being movable along a first path from a first position remote from said first roll to a second position adjacent to said first roll, second means defining a load path extending across said first path and moving a load along said load path into and beyond said film curtain whereby said film partially envelops said load, operation of said first means to move said second roll toward said first roll causing said film to completely envelop said load, and sealing means for sealing said film about said load.

2. The apparatus defined in claim 1 and including a movable carriage supporting said second roll of wrappng film and transporting said second roll from said first position to said second position.

3. The apparatus defined in claim 1 and including an idler roll disposed adjacent to and ahead of said second roll in its line of travel, said idler roll guiding said film as said second roll moves from said first position to said second position.

4. The apparatus defined in claim 1 and including clamping means for clamping said film in place adjacent to said sealing means.

5. The apparatus defined in claim 3 wherein, when said second roll is in said second position, said film is completely wound around said load and overlaps itself adjacent to said sealing means.

6. The apparatus defined in claim 4 wherein said clamping means comprises a pair of mating members having two layers of film between them.

7. The apparatus as defined in claim 6 wherein one of said members is fixed adjacent to said first fixed roll of film, and the other member is pivotably mounted adjacent to said second roll of film.

8. The apparatus defined in claim 1 and including a horizontal platform, said first roll being supported on said platform, a movable carriage coupled to said platform and supporting said second roll of film, and means coupled to said platform for driving said carriage along said path of travel.

9. The apparatus defined in claim 1 and including braking means coupled to said first and second rolls of film for controlling the rotation of such rolls and the tension on the sheet of film between them as a wrapping operation is performed.

10. The apparatus defined in claim 8 and including film clamping means disposed adjacent to said sealing means, said clamping means comprising first and second mating U-shaped members, the first member being fixed adjacent to said first roll, and said second member being pivotably mounted on said movable carriage and movable into operative relation with said first member when said carriage moves said second roll of film to said second position.

11. Apparatus for stretch-wrapping a load with a plastic film comprising a first vertical roll of wrapping film, said first roll of film being fixed in place, a second vertical roll of wrapping film, which is normally spaced from said first roll, a load support and wrapping area disposed between said first roll and said second roll, horizontally movable carriage means for supporting said second roll of film and moving said second roll toward and away from said first roll along a single substantially straight line path of travel having a first end and a second end, said path of travel being such that, when said carriage means is at said first end thereof, said second roll of film is remote from said first roll and the film extends as a curtain from said first roll to said second roll across the space between them, said curtain of film enclosing a portion of a load to be wrapped, and, when said carriage means is at said second end of said path of travel, said second roll of film is adjacent to said first roll and said film completely surrounds said load, a portion of the film of said first roll overlapping a portion of the film of said second roll and thereby forming a region where the overlapping films form two layers of film material, and means for sealing said films together at said overlapping portion to complete the wrapping of said load.

12. Apparatus for stretch-wrapping a load with stretchable film comprising first means including a fixed first roll, second means including a second roll on a movable carriage, said second roll being movable with said carriage along a first path from a first position remote from said first roll to a second position adjacent to said first roll, wrapping film on said first and second rolls and forming a film curtain between said rolls, third means for moving a load into said curtain of film to cause said film to envelop a portion of said load, movement of said second roll by said second means to a position adjacent to said second roll causing said film to completely envelop said load, and sealing means for sealing said film about said load.

13. The apparatus defined in claim 12 and including an auxiliary roll positioned adjacent to said first roll and positioned between said first roll and said second roll and supporting said film whereby, when said first and second rolls are positioned adjacent to each other, two layers of film are formed on said auxiliary roll, and said sealing means forms a seal along said two layers of film.

14. The apparatus defined in claim 12 and including an idler roll disposed on said carriage adjacent to and ahead of said second roll in its line of travel, said idler roll guiding said film as said second roll moves from said first position to said second position.

15. The apparatus defined in claim 12 and including clamping means for clamping said film in place adjacent to said sealing means.

16. The apparatus defined in claim 15 wherein said clamping means comprises a pair of mating U-shaped members having two layers of film between them.

17. The apparatus defined in claim 16 wherein one of said U-shaped members is fixed adjacent to said first fixed roll of film, and the other U-shaped member is pivotably mounted on said carriage adjacent to said second roll of film.

18. Apparatus for stretch-wrapping a load with film comprising a platform having an area for receiving a pallet load, said platform being positioned adjacent to a first path of travel along which said pallet load travels on its way to said area of said platform, a first roll of wrapping film and a second roll of said wrapping film, said film extending between said first and second rolls, said rolls defining the ends of a second path disposed generally transverse to said first path and positioned ahead of said area on said first path whereby, when a pallet load travels along said first path, it meets said film before it reaches said area and said film partially envelops said load when it reaches said area, said first roll of film being disposed vertically and fixed in place, first means for moving said load along said first path of travel into said curtain of film to cause said film to partially envelop said load, and carriage means for supporting said second roll of film vertically and moving said second roll along said second path of travel so that said film is completely wrapped around said pallet load when said second roll is moved to the second end of said second path of travel adjacent to said first roll.

19. The apparatus defined in claim 18 and including heat-sealing means disposed adjacent to said second end of said second path of travel for sealing said film about said pallet load.

20. The apparatus defined in claim 19 and including clamping means adjacent to said second end of said second path of travel for clamping said film in position as said sealing means is operated to perform a sealing operation.

21. The apparatus defined in claim 20 wherein said clamping means comprises a pair of mating U-shaped members clamping two layers of film between them.

22. The apparatus defined in claim 21 wherein one of said U-shaped members is fixed adjacent to said first fixed roll of film, and the other U-shaped member is pivotably mounted on said carriage means adjacent to said second roll of film.

23. The apparatus defined in claim 18 wherein said carriage means comprises a rod-like member for receiving said second roll of film, an idler roll positioned adjacent to and ahead of said second roll of film in said second path of travel, an auxiliary roll positioned adjacent to and behind said second roll of film in said second path of travel, said rod-like member, said idler roll, and said auxiliary roll all being oriented vertically and parallel to each other, and coupling plates secured to said rod-like member, said idler roll and said auxiliary roll to form a rigid assembly therewith.

24. The apparatus defined in claim 23 and including a track formed beneath the top surface of said platform, said rigid assembly being positioned adjacent to said track, and drive means in said track and coupled to said rigid assembly for driving said rigid assembly along said second path of travel.

25. Apparatus for stretch-wrapping a load with film comprising a platform having a front edge and a top surface which has an area for receiving a pallet load to be wrapped, said pallet load being adapted to be driven along a first path of travel which lies generally perpendicular to said front edge of said platform, a drive track disposed beneath said top surface of said platform adjacent to said front edge thereof, said pallet load having a front surface which is adapted to be aligned with the front edge of said platform, a first roll of wrapping film disposed vertically on said platform adjacent to the front edge of said platform and adjacent to one corner of said pallet load when the load is in place for wrapping, a first clamping bar disposed vertically on said top surface of said platform between said corner of said pallet load and said first roll of film, a second roll of wrapping film vertically disposed adjacent to the front edge of said platform, an idler roll disposed vertically between said second roll of film and said pallet load, a movable carriage supporting said idler roll and said second roll of film vertically for moving said second roll along a second path of travel having a first end and a second end, said second path of travel being generally transverse to said first path, said first end of said path placing said idler roll and said second roll remote from said first roll and said second end placing said idler roll and said second roll adjacent to such first roll, when said movable carriage is at said first end of said second path of travel, said film extends from said second roll, about said idler roll, about three sides of said load, about said clamping bar, to said first roll, when said movable carriage moves along said path of travel toward said second end, it wraps said film about the front surface of said pallet load to complete the wrapping thereof, and it also provides two layers of film on said first clamping bar, a second clamping bar on said movable carriage and pivotable to engage said first clamping bar with said two layers of film between them, and heat-sealing means for sealing together said two layers of film held between said first and second clamping bars.

26. Stretch-wrap packaging apparatus comprising a load area at which a load is positioned to be packaged, first means forming a curtain of film in front of said load area, said film extending partially about said load area and a load positioned thereat when a load has been moved onto said load area, said first means including a portion movable across said load area and the load positioned thereat to cause said film to completely envelop said load, said first means including first and second rolls on which said film is wound and between which said film extends, as a curtain, when said first and second rolls are spaced apart, said first roll comprising said movable portion and being movable toward and away from said second roll, second means for moving a load along a path extending across said curtain of film to said load area, and sealing means for sealing said film securely about said load.

27. The apparatus defined in claim 26 wherein said rolls are positioned closely adjacent to each other when said load is completely enclosed and when said sealing means is operated to seal said film about said load.

28. The apparatus defined in claim 26 wherein said first means includes a portion for forming two layers of said film when said movable portion envelops said load, said sealing means forming a seal along said two layers of film.

29. The apparatus defined in claim 26 wherein said first means includes an idler roll adjacent to said second roll and positioned between said first roll and said second roll and supporting said film whereby, when said first and second roll of said film are positioned adjacent to each other, two layers of film are formed on said idler roll at which said sealing means forms a seal.

30. Apparatus for stretch wrapping a load with stretchable film comprising a work area at the end of a first path of travel at which said load is wrapped and sealed, and first means for moving said load along said first path to said work area, first and second spaced-apart rolls carrying film which extends as a curtain between them, said rolls being spaced apart on a second path disposed athwart said first path and positioned ahead of said work area so that said curtain of film is disposed ahead of said work area, and said film partially envelops said load when said load moves along said first path to said work area and into said curtain of film, second means for moving one of said rolls toward the other to cause said film to completely envelop said load, and sealing means adjacent to the other of said rolls for sealing the film about said load.

31. The apparatus defined in claim 30 and including third means adjacent to said other roll and positioned between said first roll and said second roll and supporting said film whereby, when said first and second rolls are positioned adjacent to each other, two layers of film are formed on said third means, and said sealing means forms a seal along said two layers of film.

32. Apparatus for stretch-wrapping a load with stretchable film comprising a fixed first roll, a second roll including means for moving said second roll along a path from a first position remote from said first roll to a second position adjacent to said first roll, wrapping film wound on said first and second rolls and extending as a curtain between said first and second rolls when said rolls are spaced apart, a load to be wrapped disposed on one side of said path and positioned between said first and second rolls, when said rolls are spaced apart, said curtain of film extending from said first roll, around the greater portion of said load, to said second roll, when said first and second rolls are spaced apart, whereby, when said means moves said second roll toward said first roll, the film completely envelops said load, and sealing means for sealing said film about said load.

33. Apparatus for stretch-wrapping a load with stretchable film comprising first means including a first vertically oriented roll of wrapping film, said first means holding said first roll of film fixed in place but rotatable to remove lengths of film therefrom, second means including a second vertically oriented roll of said wrapping film, said second means being movable along a first path from a first position remote from said first roll to a second position adjacent to said first roll, said film extending as a curtain between said first and second rolls, and presenting a vertical front surface and a vertical rear surface, third means for moving a load, to be packaged in said film, along a second path and into said curtain of film, said third means moving said load from a position in front of and facing said front surace of said curtain of film to a position behind said film and facing said rear surface thereof, whereby said film encloses the greater portion of the surface of said load, and sealing means adjacent to said first means for sealing said film about said load when said first roll and said second roll are positioned adjacent to each other.

* * * * *